United States Patent [19]

Weston

[11] Patent Number: 4,777,668

[45] Date of Patent: Oct. 18, 1988

[54] SNAG RESISTANT TIPS FOR GARMENT FRAMES

[75] Inventor: Jerry Weston, Baldwin, N.Y.

[73] Assignee: S&S Industries, Inc., New York, N.Y.

[21] Appl. No.: 111,988

[22] Filed: Oct. 21, 1987

[51] Int. Cl.[4] ..... A41C 1/14

[52] U.S. Cl. ..... 2/257; 450/52

[58] Field of Search ..... 2/257, 256; 450/52, 450/45, 41; 604/171

[56] References Cited

U.S. PATENT DOCUMENTS

| | | | |
|---|---|---|---|
| 2,938,215 | 5/1960 | Schwartz | 2/257 |
| 3,799,175 | 3/1974 | Rowell | 2/257 X |
| 4,133,316 | 3/1974 | Schwartz | 450/52 |

*Primary Examiner*—Ronald Feldbaum

*Attorney, Agent, or Firm*—Abelman, Frayne, Rezac & Schwab

[57] ABSTRACT

A protective tip for a garment frame has lateral extensions at the recesses in the tip provided for the reception of barbs of the frame, the lateral extensions providing continuations of the peripheral contour of the tip at the locations of the recesses in order to minimize snagging of the tip as it is inserted into a channel formed in a garment.

3 Claims, 4 Drawing Sheets

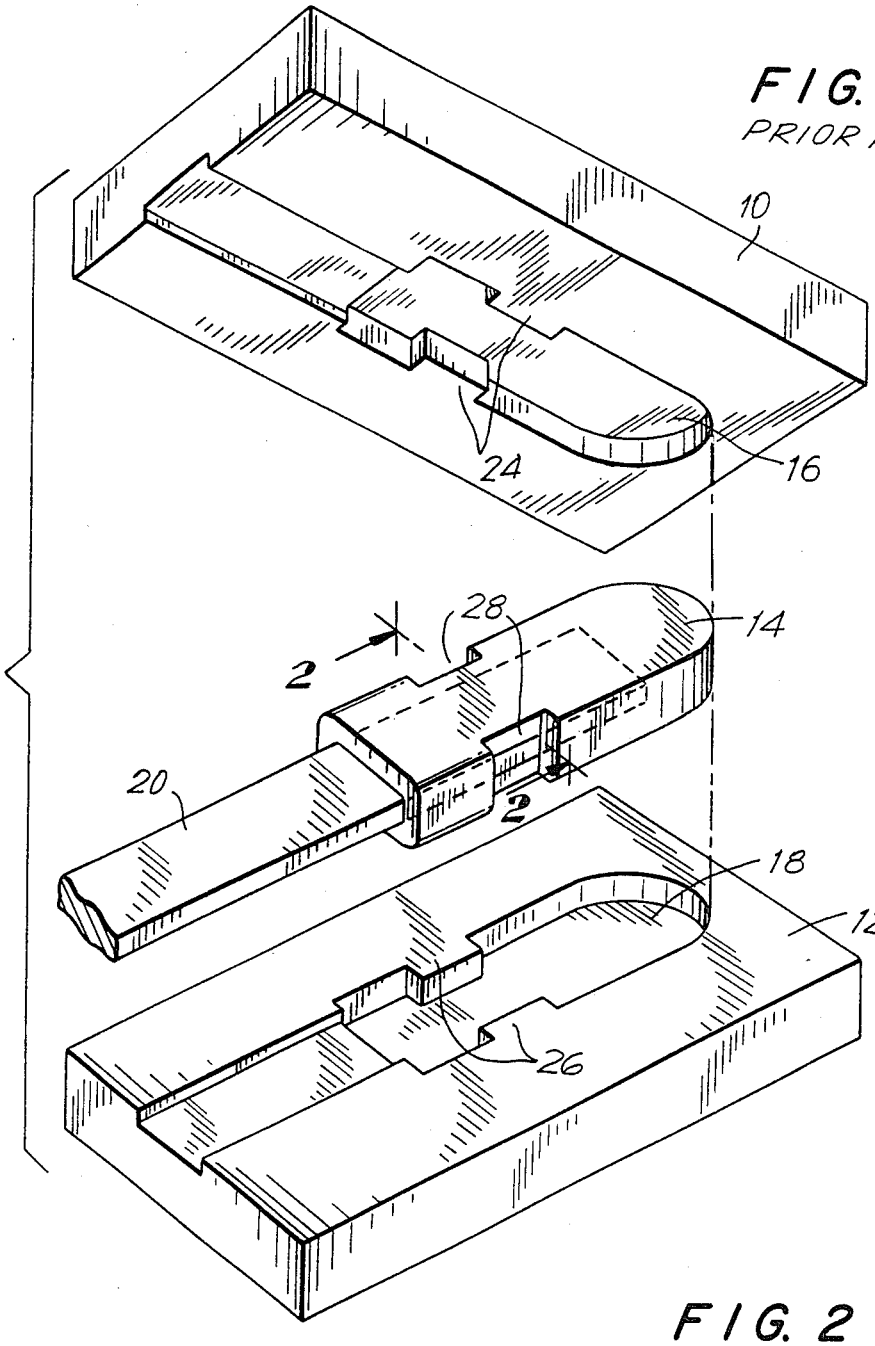
FIG. 1
PRIOR ART
FIG. 2
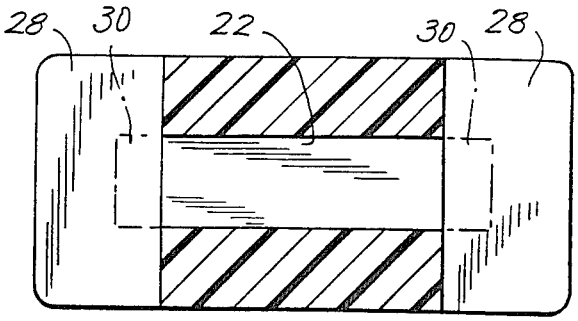

SNAG RESISTANT TIPS FOR GARMENT FRAMES

FIELD OF THE INVENTION

This invention relates to frames to be incorporated into articles of clothing in order to provide structural reinforcement for the article of clothing, and in particular relates to snag resistant tips for such garment frames.

While not limited thereto, the invention finds particular application in garment frames to be incorporated into a brassiere.

BACKGROUND OF THE INVENTION

In the manufacture of brassieres, it is common practice to incorporate a reinforcing frame into the surrounds of the brassiere cups. It also is common practice to form such frames from arcuate lengths of flat stock material of substantially rectangular cross-section, which are provided on their ends with protective tips of a compliant plastics material in order to resist abrasion and eventual wearing through of the fabric of the garment at the otherwise exposed tips.

Two modes of assembly of the garment are in common usage, one being to stitch the garment around the frame with the frame in situ, and the other being to first stitch the garment to provide a channel for the reception of the frame, and then insert the frame into the channel provided by the stitching of the garment.

The present invention, while of utility in the first mode of assembly, is directed more particularly to the latter mode of assembly, particularly in the case that, as also is common practice, padding material is provided within the channel for the purpose of providing softness along the edges of the frame. Commonly, the padding employed is a soft scrim of batting material having relatively little bonding and stabilization of the fibers comprising the batting, or, the padding is a strip of a soft foamed plastics material. Both such materials are readily susceptible to snagging during the insertion of the frame into the channel, particularly in the event that, again as is common practice, the tip itself has recesses extending inwardly thereof from its peripheral edges.

It is known from Schwartz U.S. Pat. No. 3,599,643 to provide garment frames with protective tips that are devoid of surface interruptions along their lateral edges, and which are thus highly resistant to snagging. This is possible in that a retaining tang formed on the end of the garment frame extends perpendicular to the plane of the frame, for it to extend into a recess formed in one of the major surfaces of the tip. This, however, requires that the tip, which is a force fit over the end of the frame, be of a thickness sufficient to completely submerge the tang within the confines of the tip, such that the tang itself cannot cause snagging. However, at the same time, the tang must be of sufficient axial extent to prevent the tip from being pulled off from the end of the frame, this in turn requiring that tang be of substantial length and that the tip be of adequate thickness in the direction of the tang and perpendicular to the major face of the frame.

A slimmer configuration of tip is taught in Schwartz U.S. Pat. No. 4,133,316, in which barbs are provided on the ends of the frame, the barbs extending laterally from the frame in the general plane of the frame.

This, however, requires that the lateral edges of the tips be interrupted by cut-outs for reception of the barbs, and in turn, reduces the resistance of the tip to snagging both during and subsequent to the insertion of the tip and frame into the channel of the garment.

SUMMARY OF THE INVENTION

It is an object of this invention to provide a tip having all of the advantages of the a tip of the type disclosed in Schwartz, U.S. Pat. No. 4,133,316, and which also secures the major advantage of a tip of the type disclosed in Schwartz, U.S. Pat. No. 3,559,643.

According to the present invention, the peripheral edges of the tip are continuous and uninterrupted, throughout their length, at least through a portion of the thickness of the tip in order to eliminate or further resist snagging at the peripheral edges of the tip during insertion of the frame into a garment, and, in the subsequent use of the garment.

This is accomplished by a conformation of tip which enables it to be molded in an injection mold having the same number of moveable parts as one required in the molding of a tip of the type disclosed in Schwartz, U.S. Pat. No. 4,133,316.

Such a mold of necessity includes two mold portions, the first mold defining a top surface and a portion of an end face of the tip, and the second defining a bottom surface and the remaining portion of the end face of the tip, provision being made for the insertion of a core member into the mold prior to the molding of the tip in order to provide the required axial rectangular bore in the tip for the reception of an end of the frame and its associated barb.

The first and second molds include core portions for the purpose of providing lateral recesses in the tip which communicate with the central bore in the tip. The lateral recesses are required in order to accomodate the laterally extending barbs on the frame end.

While it is conceivable that a core member could be devised which provides for recesses internally of the tip, such a core member would be prohibitively complicated and expensive, and must thus be discounted for practical reasons.

The core member employed for forming the axial bore would have to be provided with portions that could be extended laterally outwardly of the core member to provide the internal recesses during the molding operation, but, which must then be retracted into the core member in order to permit stripping of the molded tip from the end of the core member. Clearly, in addition to being highly complicated, such moveable elements on the core member would be subject to fouling by the injected thermoplastics material and subsequent seizure thereof upon the molten plastics material reaching the temperature at which it solidifies.

The present invention overcomes this problem by providing a tip configuration that can be molded on a standard core using molds that are moveable relative to each other and away from the core member in a standard manner, but, which will also provide for bridging of the recesses and a continuous periphery of the tip throughout a portion or all of its thickness.

According to the present invention, at least one of the major surfaces of the tip is uninterrupted for the periphery of the tip to provide a bridging portion at that location and thus be continuous and thus snag resistant at that location, the bridging portion terminating in a plane including of the adjacent planar surface of the rectangular bore formed in the tip.

Optionally, the laterally outer edges of the bridges are extended upwardly to further increase the snag resistance of the tip, while at the same time preserving the required free space within the tip for the reception of the frame barbs.

In an ultimate extension of the inventive concept, the outer surfaces of the bridges extend continuously between the lower major surface of the tip and the upper major surface of the tip, and the recesses are provided by slots in one of those surfaces extending perpendicular to the plane of the rectangular bore and respectively communicating with the lateral sides of that bore.

DESCRIPTION OF THE DRAWINGS

Preferred embodiments of the invention will now be described with reference to the accompanying drawings, in which:

FIGS. 1 and 2 are illustrative of a conventional tip that has been formed on a core by conventional molds, FIG. 2 being a cross-section taken on the line 2—2 of FIG. 1;

DESCRIPTION OF THE PRIOR ART EMBODIMENT

Figure 3:
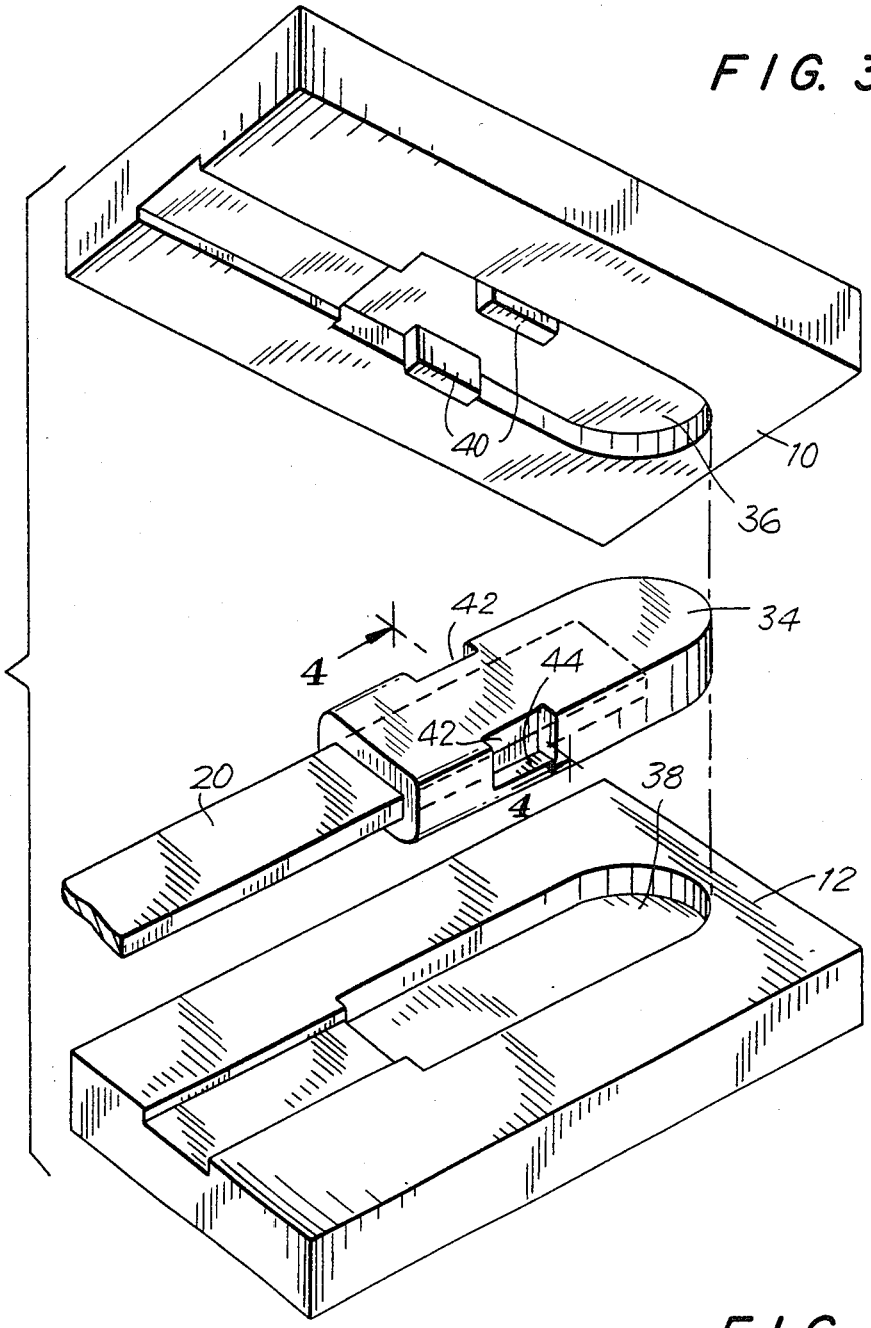
FIGS. 3 and 4 are illustrative of a first preferred embodiment of the present invention, FIG. 4 being a cross-section taken on the line 4—4 of FIG. 3.

Referring now to FIGS. 1 and 2, which show conventional molds for molding a conventional tip of the type disclosed in Schwartz, U.S. Pat. No. 4,133,316, the molds include a top molding die 10 and a bottom molding die 12 which are to be employed in the molding of a protective tip 14 by conventional injection molding techniques. For convenience, the top and bottom molding dies 10 and 12 have been shown in a generally horizontal attitude. It will be appreciated that the molding dies could be in any other position as required in a particular injection molding machine.

The top molding die 10 includes a molding cavity 16, and the bottom molding die 12 includes a molding cavity 18, the respective molding cavities being a mirror image of each other in order to produce a symmetrical configuration of the protective tip 14.

Preparatory to molding the protective tip 14, a core member 20 [FIG. 1] is positioned within the molding dies, the purpose of the core member 20 being to form an axial bore 22 [FIG. 2] in the protective tip, the protective tip 14 being molded in situ around the core member 20, and subsequently stripped from the core member 20.

While molding dies for the molding of a single protective tip 14 have been illustrated, in practice, the molding dies will include cavities for the molding of a multiplicity, for example, up to 100 protective tips 14 in a single shot of the injection molding machine. In this event, the core members 20 required for the formation of each protective tip 14 can be formed as the tangs of a comb-like member to be inserted into the molding die in a position such that the respective tangs comprising the core members 20 are simultaneously positioned in correct orientation for them to each extend into an associated molding cavity of the molding dies.

The top molding die 10 is provided with core portions 24 that extend into the molding cavity, and, the bottom molding die 12 includes corresponding core portions 26 extending into the mold cavity, the core portions 24 and 26 being configured identically with each other, and being provided for the purpose of forming lateral recesses 28 in the opposite peripheral edges of the tip 14. These lateral recesses 28, as more clearly illustrated in FIG. 2, intersect with the sides of the rectangular bore 22 to provide lateral openings at the sides of the bore 22, the purpose of the lateral openings being to permit tangs, indicated in chain lines at 30 to extend outwardly from the axial bore and be positioned within the lateral recesses 28, the purpose of the tangs being to prevent removal of the protective tip from the ends of the frame after the tip has been forced fitted over the end of the frame.

While this construction of tip performs excellently, and is in widely accepted use, it does pose one problem when being inserted into a pre-formed channel in a garment, particularly a channel which is lined with scrim or soft foamed plastics materials. That problem arises from the lateral recesses 28 in the tip, and, the tendency of the lining material to bunch-up in the recesses 28, the relatively sharp edges of the recesses and the positioning of the recesses provoking such bunching-up at the edges of the recesses.

It is this particular problem to which the present invention is directed.

DISCUSSION OF THE BASIC PROBLEM

The underlying problems confronting the present applicant are that, on the one hand, it would be preferable to eliminate the lateral recesses 28 in their entirety, but, those lateral recesses are essential in order to provide space in which the barbs of the frame can be accomodated, this requiring that the recesses provide lateral openings from the axial bore 22.

The next problem is that the configuration of the respective molding dies must be such that the molded tip will release from the dies after a molding operation. This is arranged for in the prior art by providing symmetrical molding cavities, such that on withdrawal of the dies from each other, the core members 20 and the molded tip 14 can be lifted out of the molds, and the core member 14 then stripped from the core member 20.

On the other hand, it would be preferable that the laterally extending recesses 28 be omitted in their entirety, and, that the tip 14 be continuous in planform throughout it entire periphery, at least throughout a portion of the thickness of the tip. The manner in which this objective can be accomplished according to the present invention is now discussed with respect to the preferred embodiments.

DESCRIPTION OF THE PREFERRED EMBODIMENTS

Figure 4:
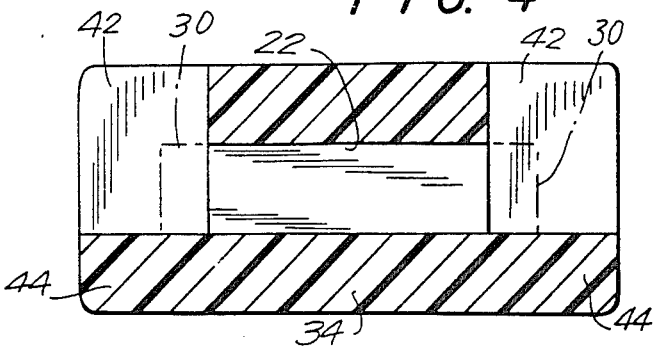

Referring now to FIGS. 3 and 4, a similar organization of top molding die 10, bottom molding die 12, and core member 20 is employed to form a tip 34 according to the present invention.

The top molding die 10 has a molding cavity 36, and, the bottom molding die 12 has a bottom molding cavity 38.

Contrary to the prior art teachings, the bottom molding cavity 38 of the bottom molding die 12 is devoid of inwardly extending core portions, such as the portions 26 in FIG. 1, and, the core portions 40 of the top molding die 10 are extended downwardly such that their planar end faces are located co-planar with the bottom planar face of the core member 10 at the time the molding dies are closed.

This gives rise to a configuration of tip shown more clearly in FIG. 4, in which the lateral recesses 42 extend only partially through the thickness of the tip 34, and terminate in co-planar relationship with the bottom surface of the axial bore 22.

Thus, adequate space is provided for the reception of the barbs 30 of the frame, while at the same time the barbs 30 are retained submerged within the confines of the tip. Further, laterally extending portions 44 are provided on the tip which bridge the lateral recesses 42, and provide continuations of the periphery of the tip 34 at those locations, thus minimizing the possibility of snagging during the insertion of the tip 34 attached to a garment frame into a pre-formed channel in the garment.

As will be observed, this formation has been accomplished in the absence of re-entrant members extending into the mold cavity 38, and, in a manner having no effect on the subsequent withdrawal of the molded tip from the molds and the stripping thereof from the core member 20.

Figure 5:
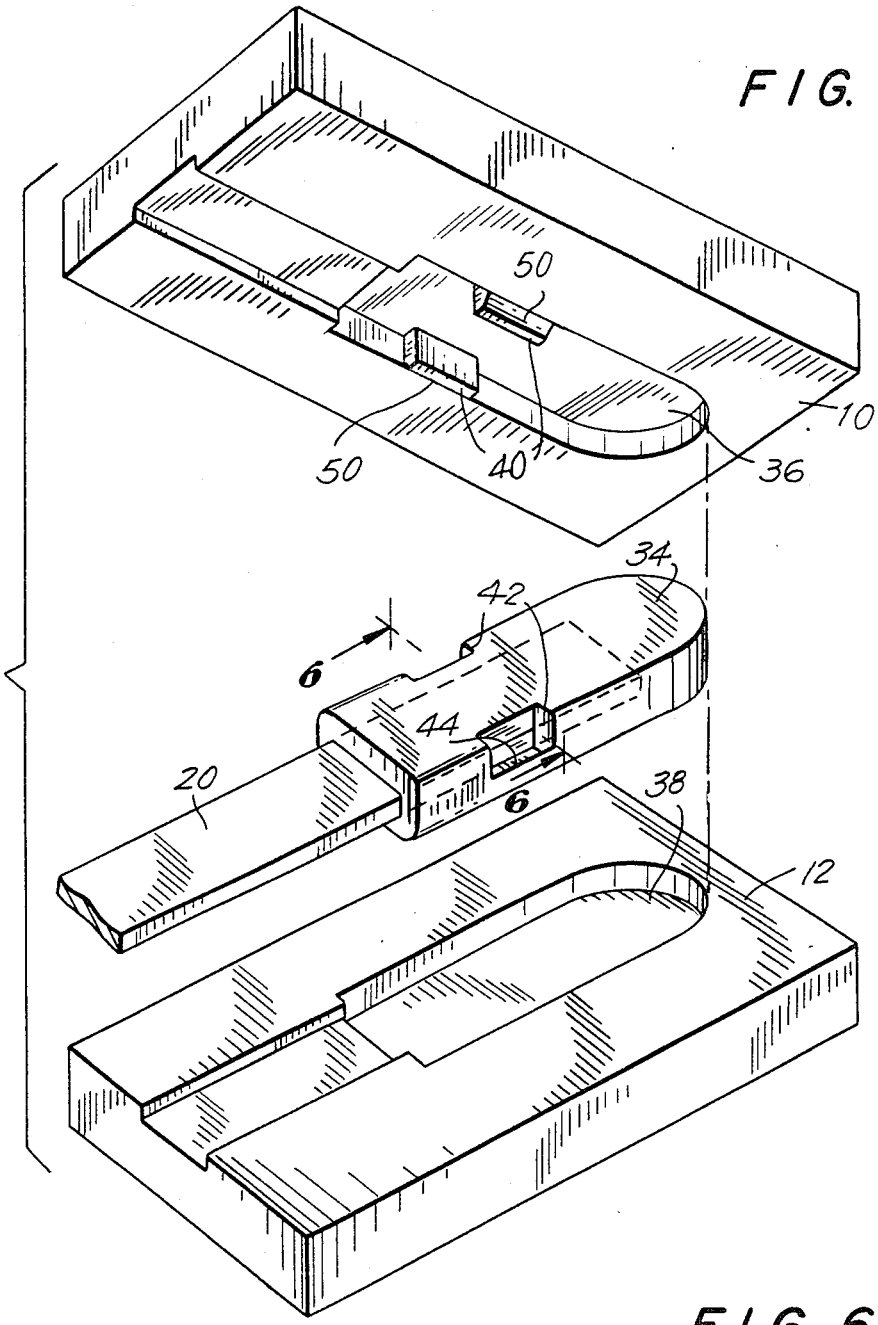
FIGS. 5 and 6 are illustrative of a second preferred embodiment of the present invention, FIG. 6 being a cross section taken on the line 6—6 of FIG. 6; and, FIGS. 7 and 8 are illustrative of a further preferred embodiment of the present invention, FIG. 8 being a cross-section taken on the line 8—8 of FIG. 7.
Figure 6:
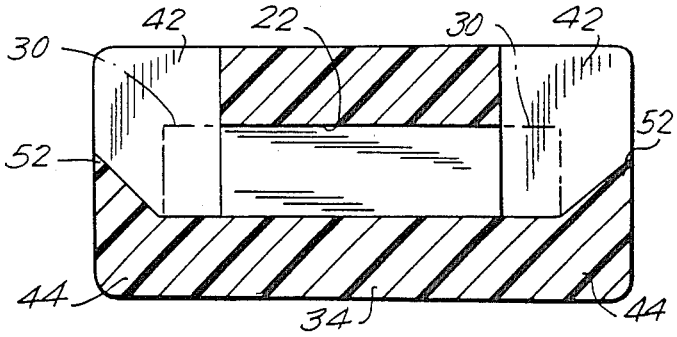

A modification of this concept is illustrated in FIGS. 5 and 6, in which the same reference numerals have been employed to indicate structures corresponding with FIGS. 3 and 4.

In FIGS. 5 and 6, the modified core portions 40 have been further modified by bevelling the laterally outermost faces of the core portions as indicated at 50.

This gives rise to a configuration of molded tip in which the lateral edges of the laterally extending portions 44 are extended upwardly at 52, in order for them to provide enhancements of the laterally extending portions 44 at the peripheral edges of the tip 34, and which extend upwardly of the thickness of the tip to a greater extent. Thus, the ability of the tip 34 to pass within a pre-formed channel in a garment in the substantial absence of snagging is further enhanced, while at the same time providing the recesses in the tip necessary to accomodate the barbs 30 of the frame.

Figure 7:
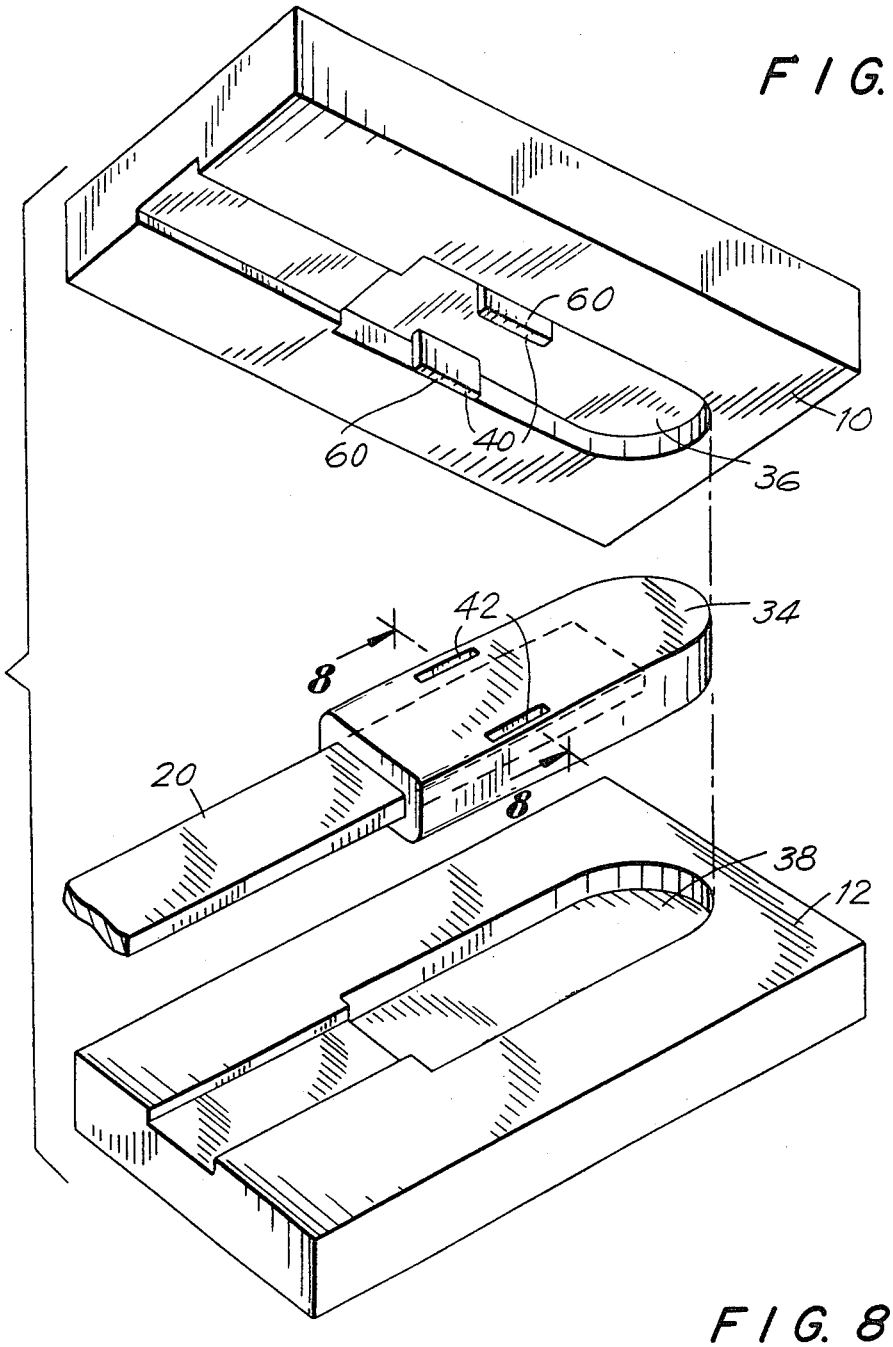
Figure 8:
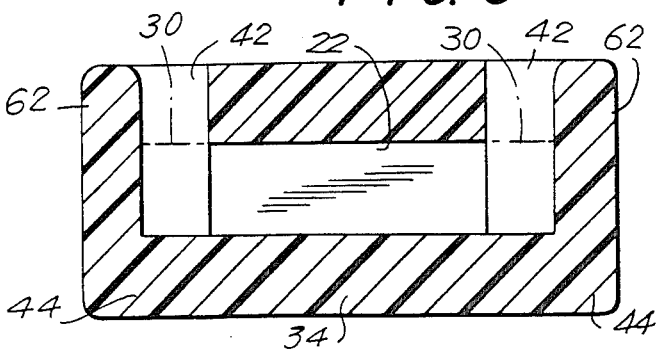

A further extension of this concept is illustrated in FIGS. 7 and 8, in which the lower die 12, similarly is devoid of inwardly extending core portions, such as the core portions 26 of FIG. 1. The inwardly extending core portions of the top molding die 10 are further modified for the laterally opposed side faces 60 of the cores portions 40 to be spaced laterally inwardly of the periphery of the molding cavity 36. In this manner, and as more clearly illustrated in FIG. 8, upward extensions of the laterally extending portions 44 are provided which extend throughout the thickness of the tip 34, thus providing continuous bridging portions for the laterally extending recesses 42, while at the same time providing sufficient space within the tip for the reception of the barbs 30 of the garment frame.

In this manner, continuous bridging of the recesses 42 is provided, while at the same time avoiding any re-entrant portions of the mold cavity, and, permitting the molded tip 34 to be stripped from the mold cavity and then from the core member 20 without interference from re-entrant portions of the mold.

It will be understood that the embodiments discussed above are preferred embodiments of the present invention, and, that various modification thereto may be made within the scope of the appended claims.

I claim:

1. In a protective tip for a garment frame having a substantially rectangular cross-section and which has laterally extending barbs adjacent free ends thereof extending in the general plane of the garment frame, said tip comprising an elongate molding of a compliant plastics material having a substantially rectangular axial bore of corresponding cross-section to the cross-section of said frame for the reception of an end of said frame, said tip including recesses in opposite lateral edges thereof communicating with said axial bore and for the reception of said frame barbs, said recesses constituting discontinuities in the peripheral contour of said tip, the improvement comprising:

portions of said tip providing continuations of the peripheral contour of said tip at said recesses;

said portions each comprising a lateral extension of one major face of said tip at the associated recess, and which terminates in a lateral edge portion providing a continuation of the peripheral contour of said tip at said recess;

at least a portion of an opposite face of each said laterally extending portion extending laterally of said tip and providing a lateral continuation of an adjacent laterally extending wall of said axial bore;

whereby to provide a free space at said recesses for accomodating a said barb of a said frame.

2. The tip according to claim 1, in which said lateral extensions terminate outwardly of said axial bore in upwardly inclined surfaces located at a position spaced beyond the ultimate position of a said barb, whereby to increase the thickness of said laterally extending portions at the peripheral contour of said tip.

3. The tip of claim 1, in which said upwardly inclined surfaces extend to the opposite major face of said tip in spaced relation with the communication of said recesses with the lateral sides of said axial bore, and each provide a free space for the accomodation of a said barb of a said frame.

* * * * *